US008070525B2

(12) United States Patent
Hou et al.

(10) Patent No.: US 8,070,525 B2
(45) Date of Patent: Dec. 6, 2011

(54) ELECTRICAL CONNECTOR ASSEMBLY WITH AN IMPROVED SHELL

(75) Inventors: Li-Chun Hou, Kunshan (CN); Chin-Te Lai, Tu-Cheng (TW); Su-Feng Liu, Kunshan (CN); Hong-Zhen Luo, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 34 days.

(21) Appl. No.: 12/688,924

(22) Filed: Jan. 18, 2010

(65) Prior Publication Data

US 2010/0184338 A1 Jul. 22, 2010

(30) Foreign Application Priority Data

Jan. 18, 2009 (CN) ..... 2009 2 0300272

(51) Int. Cl.
*H01R 24/00* (2006.01)

(52) U.S. Cl. ..... 439/660

(58) Field of Classification Search ..... 439/660, 439/607.01, 607.17, 607.51, 391, 497
See application file for complete search history.

(56) References Cited

U.S. PATENT DOCUMENTS

| | | | | |
|---|---|---|---|---|
| 2005/0255752 | A1 | 11/2005 | Huang | |
| 2006/0148319 | A1* | 7/2006 | Huang | 439/607 |
| 2009/0017683 | A1* | 1/2009 | Lin | 439/609 |
| 2009/0203261 | A1* | 8/2009 | Ikegami et al. | 439/628 |

FOREIGN PATENT DOCUMENTS

CN 2930006 Y 8/2007

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector assembly includes an insulative housing (1) with a plurality of terminal passages (12), a plurality of contacts (2) received in the corresponding terminal passages, and a shell (5) enclosing the insulative housing. The shell has a top shell (51) and a bottom shell (52) assembled with each other, the bottom shell comprises a frame-shaped base portion (520) and an extension portion (523) extending backwards and bent downwards from the base portion. The base portion defines a top wall (5201), a bottom wall (5202) and a pair of side walls (5203) connecting with the top wall and the bottom wall, the extension portion has a bottom surface lower than the bottom wall of the base portion and a pair of side portions bent upwards from lateral edges of the bottom surface, the side walls of the base portion and the side portions of the extension portion have a locking mechanism engaging the base portion with the extension portion.

16 Claims, 6 Drawing Sheets

ELECTRICAL CONNECTOR ASSEMBLY WITH AN IMPROVED SHELL

BACKGROUND OF THE INVENTION

1. Field of the Invention

The present invention generally relates to an electrical connector assembly, and more particularly to an electrical connector assembly used for high definition signal transmission.

2. Description of Related Art

Developed by Sony, Hitachi, Thomson (RCA), Philips, Matsushita (Panasonic), Toshiba and Silicon Image, the High-Definition Multimedia Interface (HDMI) has emerged as the connection standard for HDTV and the consumer electronics market. HDMI is the first digital interface to combine uncompressed high-definition video, multi-channel audio and intelligent format and command data in a single digital interface.

An electrical connector in accordance with HDMI standard comprises an insulative housing, a number of contacts received in the insulative housing, and a metallic shell shielding the insulative housing. U.S. Pub. No. 2005/0255752A1 published to Huang on Nov. 17, 2005 discloses an electrical connector compatible with HDMI transmitting protocol, the electrical connector has a shielding member with a pair of retaining arms extending rearwards from lateral sides and a rear shell with a pair of locking portions bent inwards, and each retaining arm defines a cutout therein, the locking portions are inserted into the corresponding cutouts to make the shielding member be assembled with the rear shell. However, the linking area therebetween maybe unstable and the assembling process thereof is complicated. Chinese patent No. 2930006Y published on Aug. 1, 2007 discloses another electrical connector, the electrical connector has a shielding member extending rearwards to form a bottom shell, a bottom wall of the shielding member extends rearwards to form a supporting portion of the bottom shell, and the supporting portion defines a pair of side walls bent downwards and separate from the front segment of the shielding member, but the shielding member is shaky easily, so the assembling member may be disengaged from each other.

Correspondingly, it is desired to have an electrical connector assembly with improved shell to address the problems stated above.

BRIEF SUMMARY OF THE INVENTION

Accordingly, an object of the present invention is to provide an electrical connector assembly having an improved shell increasing the receiving space and enhancing the intensity thereof.

In order to achieve the above-mentioned object, an electrical connector assembly in accordance with the present invention comprises an insulative housing with a plurality of terminal passages, a plurality of contacts received in the corresponding terminal passages, and a shell enclosing the insulative housing. The shell has a top shell and a bottom shell assembled with each other, the bottom shell comprises a frame-shaped base portion and an extension portion extending backwards and bent downwards from the base portion. The base portion defines a top wall, a bottom wall and a pair of side walls connecting with the top wall and the bottom wall, the extension portion has a bottom surface lower than the bottom wall of the base portion and a pair of side portions bent upwards from lateral edges of the bottom surface, the side walls of the base portion and the side portions of the extension portion have a locking mechanism engaging the base portion with the extension portion.

Other objects, advantages and novel features of the invention will become more apparent from the following detailed description of the present embodiment when taken in conjunction with the accompanying drawings.

DETAILED DESCRIPTION OF THE INVENTION

Figure 1:
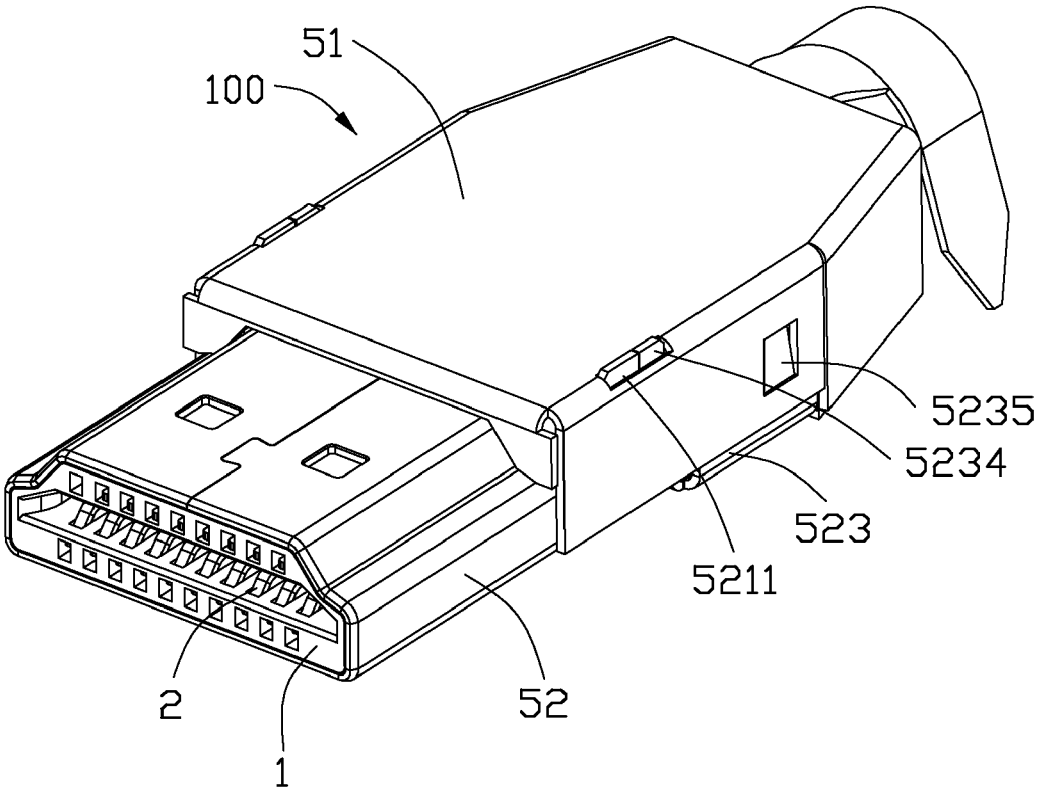
FIG. 1 is an assembled, perspective view of an electrical connector assembly of the present invention.

Reference will now be made to the drawing figures to describe the present invention in detail.

Figure 2:
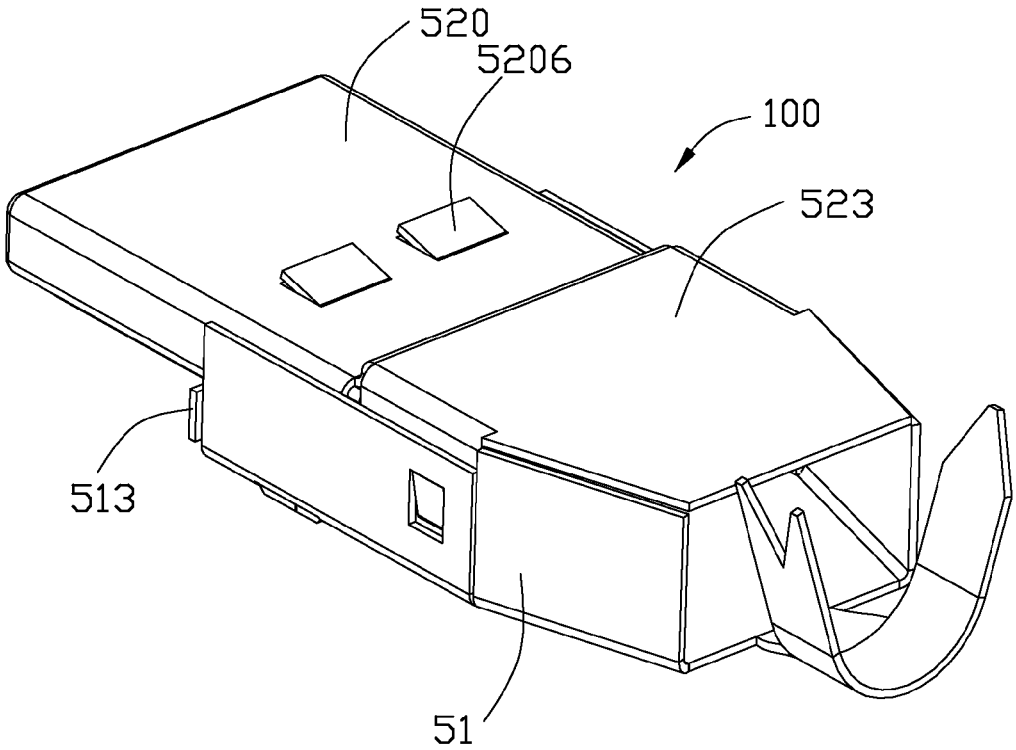
FIG. 2 is similar to FIG. 1, but viewed from another aspect.
Figure 3:
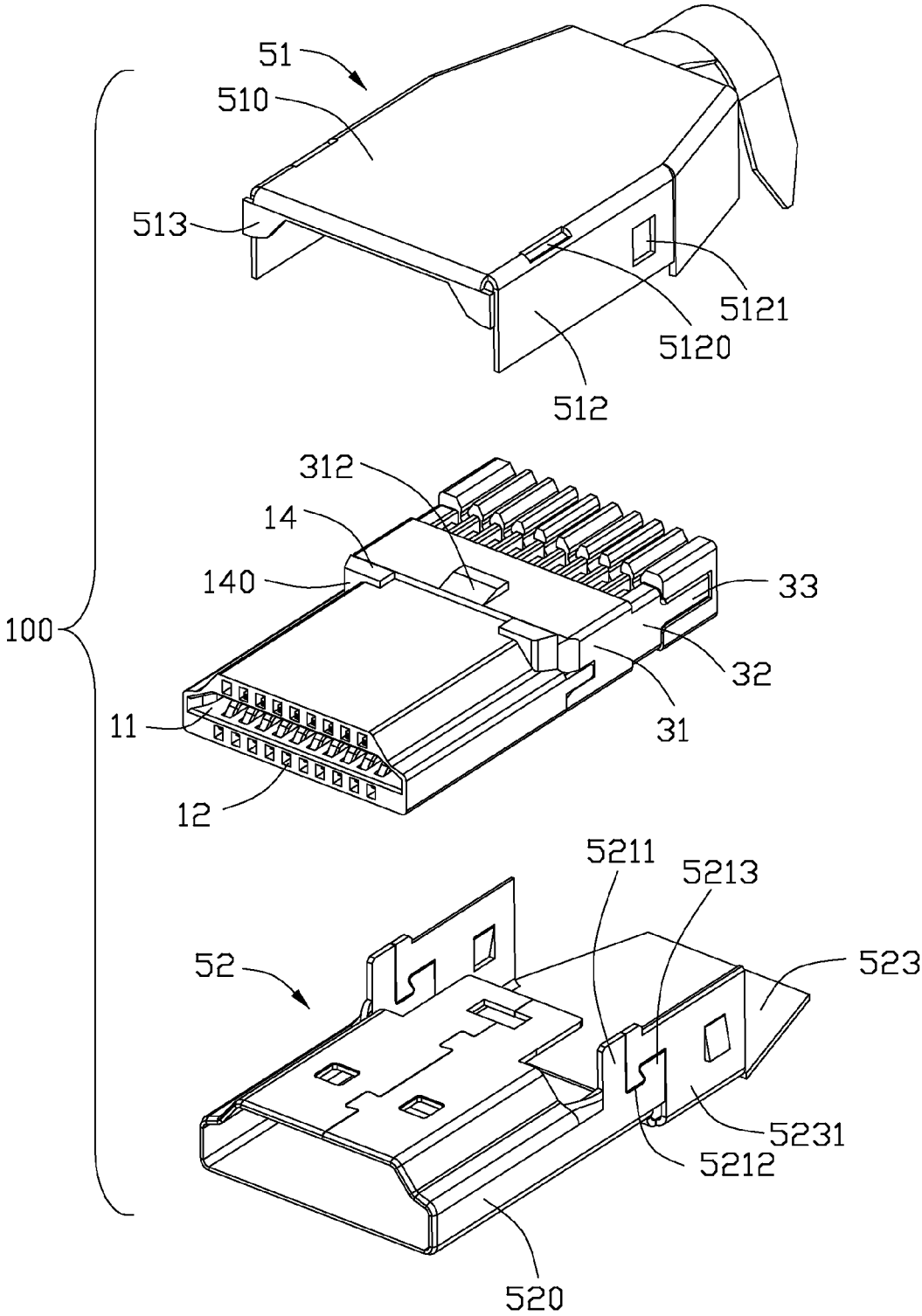
FIG. 3 is a partially exploded, perspective view of the electrical connector assembly.
Figure 4:
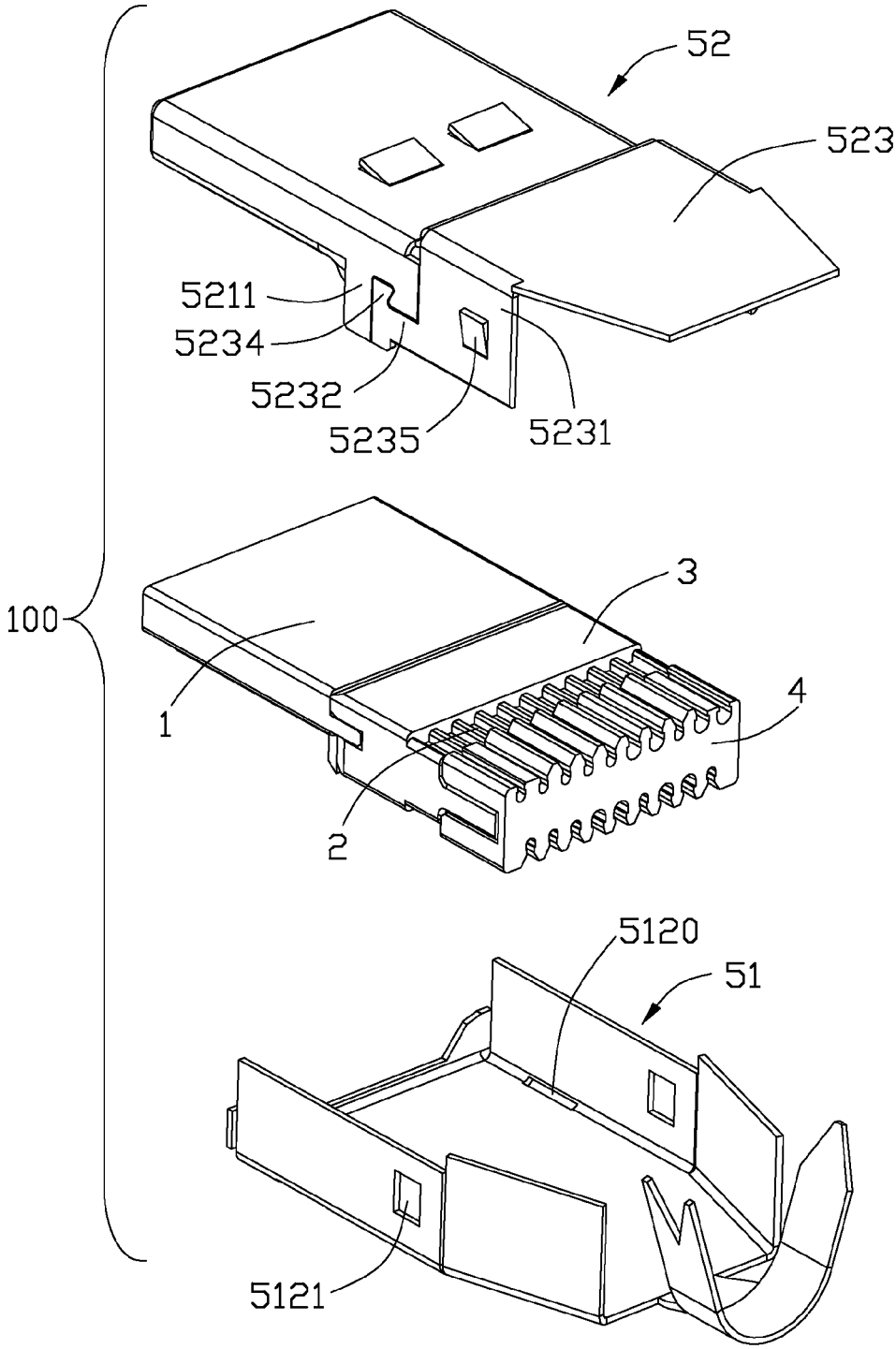
FIG. 4 is similar to FIG. 3, but viewed from another aspect.
Figure 5:
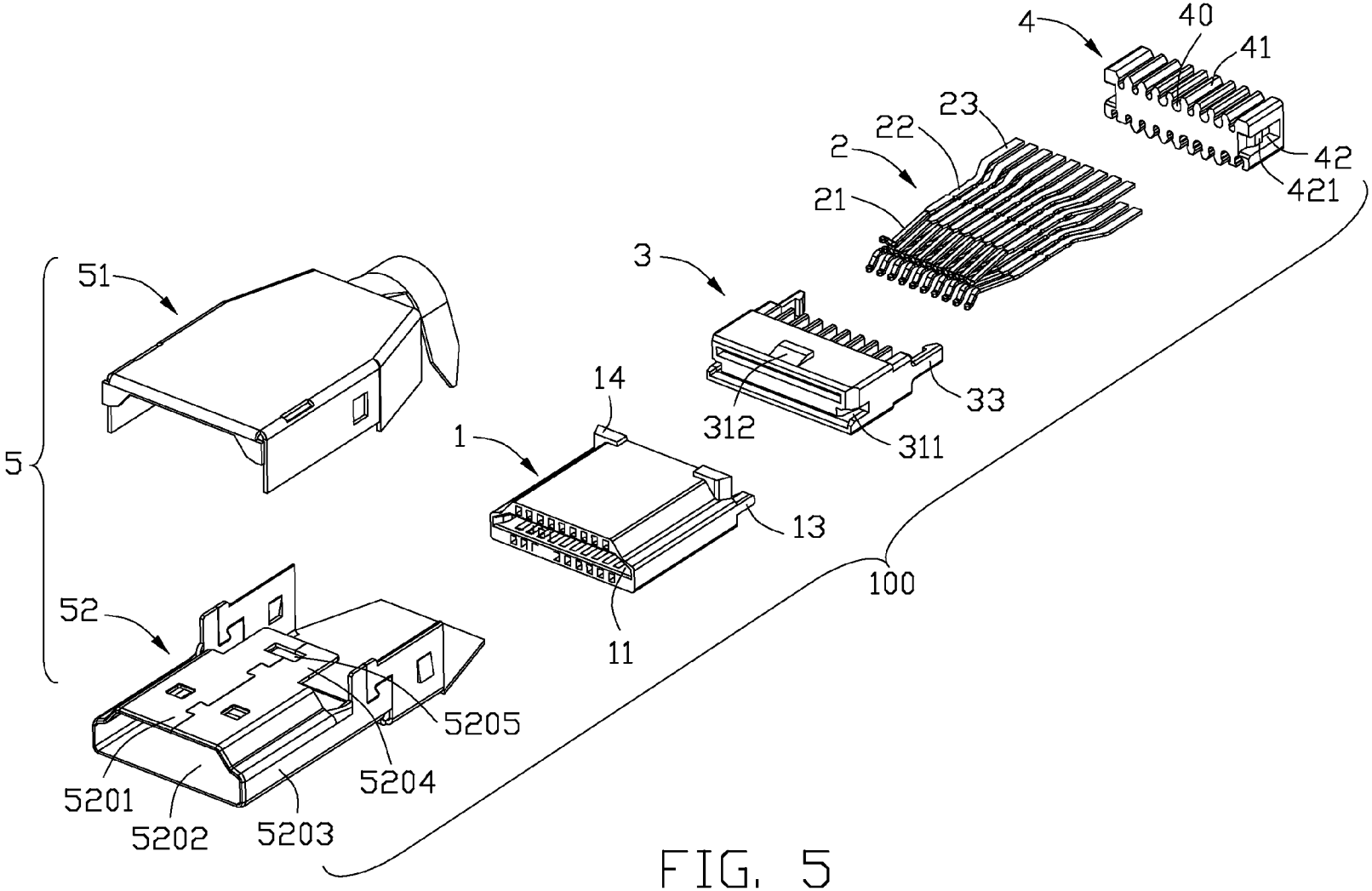
FIG. 5 is another exploded, perspective view of the electrical connector assembly shown in FIG. 3.
Figure 6:
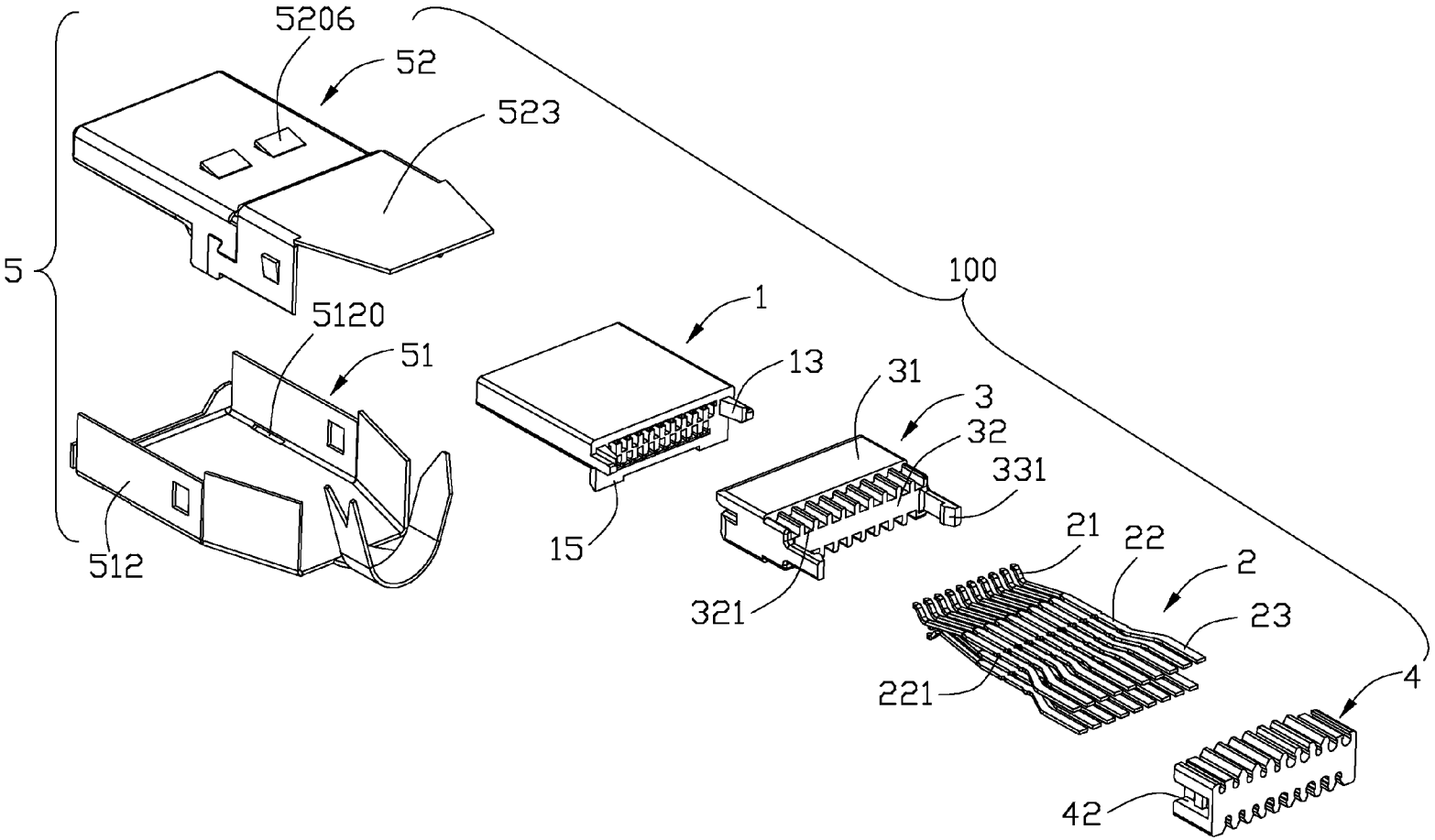
FIG. 6 is similar to FIG. 5, but viewed from another aspect.

Referring to FIGS. 1-2, an electrical connector assembly 100 in accordance with the present invention comprises an insulative housing 1, a plurality of contacts 2 received in the insulative housing 1, a spacer 3 assembled to the insulative housing 1, a wire management member 4 engaging with the spacer 3, a metallic shell 5 and a cable (not shown) with a plurality of wires.

Referring to FIGS. 3-6, the insulative housing 1 comprises a trapezoid space 11 formed by four walls in the front for receiving a complementary connector (not shown), and two rows of terminal passages 12 formed in upper and bottom walls of the insulative housing 1 and communicate with the trapezoid space 11 to receive the contacts 2. A connecting face 15 is defined on a back end of the insulative housing 1, and a pair of positioning legs 13 are extending rearwards from the connecting face 15. The insulative housing 1 defines a pair of stopping portions 14 located on a top surface thereof and protruding forwards from the connecting face 15.

The contacts 2 are inserted into the terminal passages 12 from the rear end of the insulative housing 1 along a mating direction, with elastic contact portions 21 in the front of the contacts 2 inserted into the trapezoid space 11, and tail portions 23 exposed beyond the connecting face 15 of the insulative housing 1 to connect with the wires (not shown). A plurality of barbs 221 are formed with retaining portions 22 in the middle of the contacts 2 to hold the contacts 2 in the insulative housing 1.

The spacer 3 is assembled with the wire management member 4 to form a supporting mechanism, the spacer 3 includes a main portion 31 in front thereof and a sustaining portion 32 extending rearwards from the main portion 31, a pair of locking arms 33 are projecting backwards from both sides of the sustaining portion 32, and each locking arm 33 defines an extrusion 331 on a tip end thereof. The main portion 31 defines a pair of coupling slots 311 depressed from a front surface thereof and a locking tab 312 thereon. The sustaining portion 32 defines a plurality of grooves 321 receiving the contacts 2 and extending forwards through the main portion 31.

The wire management member 4 defines a plurality of bars 41 disposed on an upper surface and a lower surface, the bars 41 are extending along the mating direction, and each two bars 41 neighboring to each other are separated by a receiving channel 40. The wires are arranged and held in the corresponding receiving channels 40. The wire management member 4 defines a pair of rectangular openings 42 on lateral sides thereof, the openings 42 are depressed rearwards from a front face of the wire management member 4, and each opening 42 defines a block 421 protruding outwards and spaced from a rear wall thereof.

In assembly, the wires are divided into two rows to be disposed in the receiving channels 40 on the upper and lower surface, front ends of the wires are exposed beyond a front surface of the wire management member 4 and insulative jackets thereof are stripped away to expose conductors of the wires.

The shell 5 is made of metallic material and comprises a top shell 51 and a bottom shell 52 assembled to each other along a direction perpendicular to the mating direction. The top shell 51 comprises an upper wall 510, a pair of lateral walls 512 bent downwards and a pair of obstructions 513 bent downwards from a front end of the upper wall 510. Each lateral wall 512 defines a through hole 5121, and a receiving hole 5120 is arranged in a connecting area between the upper wall 510 and each lateral wall 512.

The bottom shell 52 comprises a frame-shaped base portion 520 and an extension portion 523 extending backwards from the base portion 520. The base portion 520 comprises a top wall 5201, a bottom wall 5202 and a pair of side walls 5203 connecting with the top wall 5201 and the bottom wall 5202. Each side wall 5203 defines a first projection 5211 and a second projection 5213 with different heights, and the first projection 5211 is located in front of the second projection 5213 and higher than the second projection 5213. An aperture 5212 is defined between the first projection 5211 and the second projection 5213, and has an upper segment narrower than a lower segment thereof. The top wall 5201 has a latching portion 5204 extending rearwards, and a latching hole 5205 is arranged in the latching portion 5204.

The extension portion 523 is lower than the bottom wall 5202 of the base portion 520, that is to say, the extension portion 523 is extending backwards and bent downwards from a conjunction area with the base portion 520 to increase the receiving space of the bottom shell 52. A pair of side portions 5231 are bent upwards on lateral sides of the extension portion 523, and each side portion 5231 has a beam 5232 extending forwards on a tip end thereof, a third projection 5234 is defined on a front end of each beam 5232 and vertical to the beam 5232. The third projection 5234 becomes wider from up-to-down, and each third projection 5234 is spaced from the corresponding side portion 5231 to form an aperture (not numbered). Each side portion 5231 defines a protrusion 5235 projecting outwards. As the side portions 5231 of the extension portion 523 are bent upwards, the third projections 5234 are inserted into and engaging with the apertures 5212 of the base portion 520 to connect the side portions 5231 with the side walls 5203, and protect the spacer 3 and the wire management member 4. The second projections 5213 are inserted into and soldered in the aperture of the extension portion 523, and the third projections 5234 are also soldered in the apertures 5212, so as to form a locking mechanism enhancing intensity of the connection area between the base portion 520 and the extension portion 523. The base portion 520 defines a pair of tabs 5206 on a bottom surface thereof, and the tabs 5206 are connected with the base portion 520 with back ends, and front ends of the tabs 5206 are unconnected with the base portion 520. A cover (not shown) is overmolded on the shell 5, and melted material of the cover can flow and couple with the tabs 5206 to enhance the combination between the shell 5 and the cover.

Referring to FIGS. 1-4, in assembly, the contacts 2 are inserted into the terminal passages 12 of the insulative housing 1 from back-to-front, and the contacting portions 21 are exposed in the trapezoid space 11 of the insulative housing 1. The spacer 3 is assembled to the insulative housing 1 along the rear-to-front direction and adjacent to the connecting face 15 of the insulative housing 1. The tail portions 23 of the contacts 2 are extending through the main portion 31 of the spacer 3, and then received in the grooves 321. The positioning legs 13 on both sides of the insulative housing 1 are accommodated in the coupling slots 311 of the spacer 3. Then the wire management member 4 with wires is assembled to the back end of the spacer 3, the receiving channels 40 are aligned with the corresponding grooves 321, and the locking arms 33 of the spacer 3 is matched in the openings 42 of the wire management member 4, the extrusions 331 are sliding over and locked with the blocks 421.

Then aforementioned elements are disposed into the bottom shell 52 along the rear-to-front direction, the base portion 520 is enclosing the insulative housing 1, and the locking tab 312 is latched in the latching hole 5205 of the latching portion 5204. The top shell 51 is assembled to the bottom shell 52 along an up-to-down direction, with the obstructions 513 of the top shell 51 located in front of front end surfaces 140 of the stopping portions 14. The first projections 5211 of the bottom shell 52 and the third projections 5234 are inserted into the receiving holes 5120 of the top shell 51, and the protrusions 5235 are locked in the through holes 5121.

After the cover molded on the shell 5, the electrical connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative housing with a plurality of terminal passages;

a plurality of contacts received in the corresponding terminal passages; and a shell enclosing the insulative housing, and having a top shell and a bottom shell assembled with each other, the bottom shell comprising a frame-shaped base portion and an extension portion extending backwards and bent downwards from the base portion, the base portion defining a top wall, a bottom wall and a pair of side walls connecting with the top wall and the bottom wall, the extension portion having a bottom surface lower than the bottom wall of the base portion and a pair of side portions bent upwards from lateral edges of the bottom surface, the side walls of the base portion and the side portions of the extension portion having a locking mechanism engaging the base portion with the extension portion; wherein each side walls of the base portion defines a first and a second projection extending upwards and an aperture defined between the first projection and the second projection, and the side portions of the extension portion define another aperture and another projection, the projections on the base portion are accommodated in the apertures in the extension portion, and the projections on the extension portion are received in the apertures in the base portion to form the locking mechanism, the first projection and the second projection have the different heights with each other, and the first projection is higher than the second projection and located in front of the second projection.

2. The electrical connector assembly as claimed in claim 1, wherein each aperture in the side walls has an upper segment narrower than a lower segment, and each aperture in the side portions has an upper part wider than a lower part.

3. The electrical connector assembly as claimed in claim 2, wherein the projections are locked into and soldered in the corresponding apertures.

4. The electrical connector assembly as claimed in claim 2, wherein the top shell defines an upper wall, a pair of lateral walls bent downwards, a receiving hole is arranged in a connecting area between the upper wall and each lateral wall, and the projections of the bottom shell are protruding through the receiving holes.

5. The electrical connector assembly as claimed in claim 4, wherein each side portion of the extension portion has a beam extending forwards on a tip end thereof, and the projections of the extension portion are defined on front ends of the beams and vertical to the beams.

6. The electrical connector assembly as claimed in claim 5, wherein the top shell has a pair of obstructions bent downwards from a front end of the upper wall, the insulative housing defines a pair of stopping portions on a top surface thereof, and the obstructions of the top shell are located in front of the stopping portions.

7. The electrical connector assembly as claimed in claim 6, wherein each lateral wall defines a through hole to receive a protrusion projecting outwards on the bottom shell.

8. The electrical connector assembly as claimed in claim 7, wherein a spacer is assembled to the insulative housing and has a locking tab, the base portion of the shell has a latching portion formed with a latching hole, and the locking tab is accommodated in the latching hole.

9. An electrical connector assembly comprising:

an insulative housing defining a mating port and a plurality of terminal passages side by side arranged in a transverse direction and each of said terminal passages extending along a front-to-back direction perpendicular to said transverse direction;

a plurality of contacts each including a front contacting section, a rear soldering section and a middle offset section therebetween, wherein the front contacting section is disposed in the corresponding passages and includes a contact apex extending into the mating port in a vertical direction perpendicular to said transverse direction and said front-to-back direction;

an insulative spacer assembled to a rear side of the housing and defining a common cavity in a front portion thereof to commonly receive all said middle offset sections, and a plurality of slots in a rear portion thereof to respectively receive the corresponding rear soldering sections; and an insulative wire management member assembled behind the spacer to retain corresponding wires which are soldered to the corresponding rear soldering sections; wherein a pitch between every adjacent two front contacting sections is smaller than that between every adjacent two rear soldering sections.

10. The electrical connector assembly as claimed in claim 9, wherein one of said housing and said spacer is equipped with a pair of latches fastened to the other, and one of said spacer and said wire management member is equipped with another pair of latches fastened to the other.

11. The electrical connector assembly as claimed in claim 9, further including a metallic shell enclosing all said housing, said spacer and said wire management member and having a primary half and a secondary half assembled to each other in said vertical direction, wherein the primary half includes portions enclosing the housing while the second half not, and said primary half defines a front segment essentially covering both said housing and said spacer in said front-to-back direction, and a rear segment essentially covering at least said wire management member under condition that an offset section is unitarily formed and linked between the front segment and said rear segment in said vertical direction, and a dovetailed structure is formed on a side wall of one of said front segment and said rear segment to lock to the other for securement therebetween in both the vertical direction and said front-to-back direction.

12. The electrical connector assembly as claimed in claim 11, wherein said dovetail structure is formed at a boundary between the front segment and the rear segment.

13. The electrical connector assembly as claimed in claim 11, wherein the side wall of one of the front segment and the rear segment, and another side wall of the other of the front segment and the rear segment both define corresponding protrusions commonly into a same receiving hole formed in the secondary half for securing said front segment and said rear segment together in the front-to-back direction.

14. An electrical connector assembly comprising:

an insulative housing associated with at least one of an insulative spacer and a wire management member;

a mating port defined in the housing;

a plurality of contacts disposed in the housing and including contacting sections exposed into the mating port and a soldering tails exposed around said at least one of said spacer and said wire management member;

a metallic shell covering said housing and including a primary half and a secondary half assembled together in a vertical direction perpendicular to a mating direction of the mating port;

said primary half enclosing said housing and said at least one of the insulative spacer and the wire management member while said secondary half covering no housing; wherein said primary half defines a front segment essentially covering at least said housing, and a rear segment essentially covering said at least one of the spacer and the wire management member under condition that an offset section is unitarily formed and linked between the front segment and said rear segment in said vertical direction, and a dovetailed structure is formed on a side wall of one of said front segment and said rear segment to lock to the other for securement therebetween in both the vertical direction and said mating direction.

15. The electrical connector assembly as claimed in claim 14, wherein said dovetail structure is formed at a boundary between the front segment and the rear segment.

16. The electrical connector assembly as claimed in claim 14, wherein the side wall of one of the front segment and the rear segment, and another side wall of the other of the front segment and the rear segment both define corresponding protrusions commonly into a same receiving hole formed in the secondary half for securing said front segment and said rear segment together along a mating direction.

* * * * *